United States Patent [19]

Brasel

[11] Patent Number: 5,059,387

[45] Date of Patent: Oct. 22, 1991

[54] METHOD OF FORMING SHAPED COMPONENTS FROM MIXTURES OF THERMOSETTING BINDERS AND POWDERS HAVING A DESIRED CHEMISTRY

[75] Inventor: Gregory M. Brasel, Ballwin, Mo.

[73] Assignee: Megamet Industries, St. Louis, Mo.

[21] Appl. No.: 360,765

[22] Filed: Jun. 2, 1989

[51] Int. Cl.[5] ..... B22F 1/00; B22F 1/02; B22F 9/00

[52] U.S. Cl. ..... 419/23; 419/19; 419/30; 419/31; 419/36; 419/38; 419/60; 419/62; 419/63; 419/37; 419/64; 050602887/246

[58] Field of Search ..... 419/23, 30, 31, 37, 419/36, 38, 60, 62, 64, 19; 75/246

[56] References Cited

U.S. PATENT DOCUMENTS

| | | | |
|---|---|---|---|
| 3,989,518 | 11/1976 | Rueckl | 75/211 |
| 4,202,689 | 5/1980 | Ohno et al. | 75/211 |
| 4,284,431 | 8/1981 | Ohno et al. | 75/212 |
| 4,604,259 | 8/1986 | Whitman | 75/247 |
| 4,795,598 | 1/1989 | Billiet | 264/40.6 |
| 4,964,907 | 10/1990 | Kiyota et al. | 419/23 X |

*Primary Examiner*—Stephen J. Lechert, Jr.
*Assistant Examiner*—Leon Nigohasian, Jr.
*Attorney, Agent, or Firm*—Polster, Polster and Lucchesi

[57] ABSTRACT

Shaped parts are formed from a powder having the desired chemistry of the finished part by mixing the powder with a thermosetting condensation resin that acts as a binder. The resin may be partially catalyzed, or additives or surfactants added to improve rheology, mixing properties, or processing time. Upon heating, the inherently low viscosity mixture will solidify without pressure being applied to it. A rigid form is produced which is capable of being ejected from a mold. Pre-sintered shapes or parts are made by injection molding, by using semi-permanent tooling, or by prototyping. Binder removal is accomplished by thermal means and without a separate debinding step, despite the known heat resistance of thermosetting resins. Removal is due to the film forming characteristic of the binder leaving open the part's pores, by providing oxidizing conditions within the part's pores as the part is heated, and by insuring that the evolving resin vapor diffuses through the pores by heating the part in a vacuum.

33 Claims, 2 Drawing Sheets

METHOD OF FORMING SHAPED COMPONENTS FROM MIXTURES OF THERMOSETTING BINDERS AND POWDERS HAVING A DESIRED CHEMISTRY

BACKGROUND OF THE INVENTION

This invention relates to injection molding metal and ceramic powders, commonly known as Powder Injection Molding (PIM) or Metal Injection Molding (MIM). Conventional PIM processes are of two types. In the first, a carefully selected system of thermoplastic resins and plasticizers are mixed in an amount to fill the void volume of the powder. Such mixing operations are carried out in a high shear mixer, and at a temperature sufficient to decrease the viscosity of the plastics and uniformly mix the powder and resins. The resultant product is pelletized. The pellets are then reheated and injected into a cooled die where the thermoplastic resins increase in viscosity to a point where the part can be ejected from the die. Some of the binder is then removed. This is accomplished using a variety of techniques including solvent extraction, wicking, sublimation, and decomposition. This fraction of the binder is removed to provide sufficient porosity to the part and so that the remaining binder can decompose thermally and be removed from the part. This latter step is done at a low enough temperature to preclude substantial reaction of the binder with the metal powder. The above-noted techniques are well known in the art and are disclosed for example, in U.S. Pat. Nos. 4,404,166 (wicking), and 4,225,345 (decomposition). All require substantial processing time and specialized apparatus in order to first mix, and then remove the binders.

The second type of PIM process utilizes a plastic medium consisting of an organic binder and modifiers dissolved in a solvent. After mixing the binder with solvent, metal powder, and modifiers, the plasticized mass is injected, under pressure, into a heated mold. Water is expelled from the organic binder, under heat, causing an increase in viscosity sufficient to support the part during ejection from the die. Further heating of the part increases its strength and volatilizes the solvent, leaving sufficient porosity so the remaining binder can be volatilized and substantially removed at a low enough temperature that the powder does not coalesce.

Both types of processes require that additional processing be performed on the parts between the molding and sintering steps, in order to open the body of the part or to remove certain or all of the binders or byproducts. This increases equipment costs, processing time, and overhead as well as making the process more difficult to control.

In both processes, temperature control is critical for proper mixing, rheology, and part strength. This also necessitates additional equipment cost and process controls. For example, in the former processes, the solidified powder/binder mixtures need to be re-melted prior to forming on an injection molding press. This increases equipment cost due to the added complexity of presses and related tooling needed to inject the mixtures, as well as the cost of high intensity, thermally controlled mixing apparatus. In the latter described process, the need for proper temperature and the mix viscosity work opposite to each other; the screw required to inject the high viscosity mix produces heat that must be removed in order to keep the mix cool.

In any PIM process it is desirable (if less than 97% of theoretical density is acceptable for the finished part) to substitute a percentage of more expensive fine powder for a coarser powder which may be only a tenth the cost. This substitution decreases the amount of shrinkage taking place during sintering, and leads to better dimensional stability. With the above PIM process, however, the increased pre-sintered density, that naturally occurs when mixing powders of dissimilar sizes, further increases the viscosity of the mixture, compounding process control and overhead problems.

Because of these drawbacks, these processes are seldom economical for part runs of less than 5000 pieces. Even with larger quantities, the inability to use prototyping and short run molding techniques (such as silicone rubber tooling) increases preproduction and engineering costs.

SUMMARY OF THE INVENTION

Accordingly, it is an objective of the present invention to provide an improved method of manufacturing powder injection molded parts. It is another objective of the invention to provide a method that improves the mixing step of the process by forming a mixture having a viscosity of less than 150,000 cps, which can thus be mixed at room temperature by hand, or in ordinary mixers such as bread-dough mixers. Another objective of the invention is to provide a method in which parts do not require additional processing between the molding operation and the sintering step, so that the overall processing time is reduced. Another objective of the invention is to provide a method that requires low (less than 1 ton per square inch) or no pressure on the mixture as it cures into a part's shape, thus simplifying equipment needs and process control. It is yet another objective of the invention to enable the use of molding techniques other than injection molding, such as elastomer tooling.

Briefly, a method is presented for producing a part having desired chemical properties. The powder is mixed with a binder having as its primary constituent a thermosetting condensation resin. The binder is mixed with the powder in an amount sufficient to fill the void volume of the powder. The resultant mixture is then formed into the appropriate shape for the part. The part is cured and the resin forms a film which leaves the pores of the part open. Heating the part in a vacuum, to the appropriate sintering temperature, causes a localized oxidation within the pores which burns-out the film.

Other objects and features will be in part apparent and in part pointed out hereinafter.

DESCRIPTION OF THE PREFERRED EMBODIMENT

Figure 1:
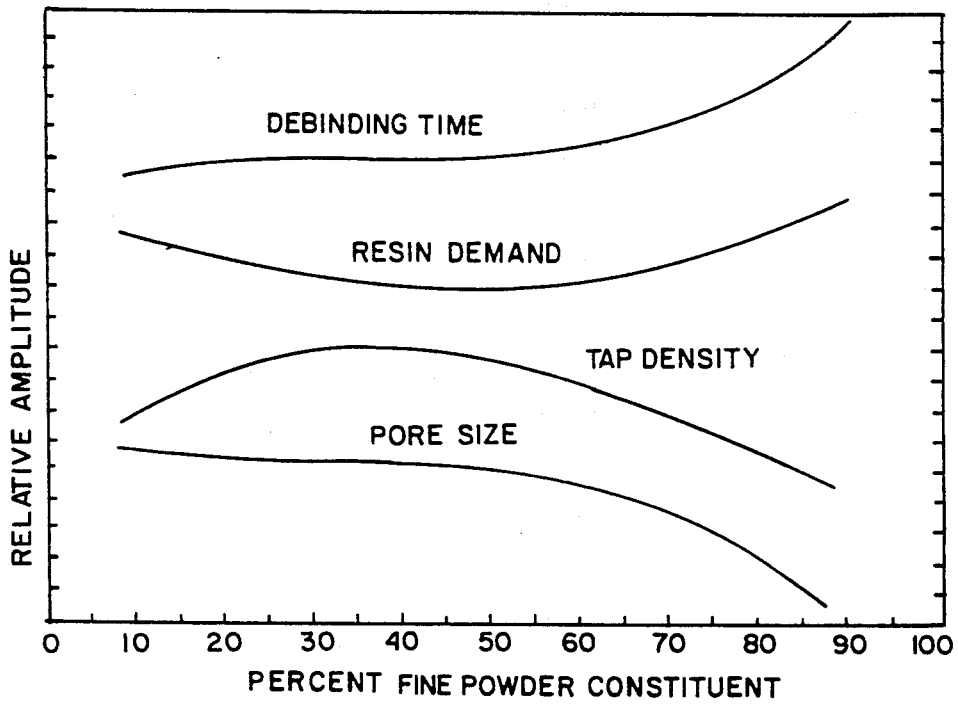
FIGS. 1 and 2 are graphs of various properties of a mixture as a function of the amount of fine powder constituents in a mixture.
Figure 2:
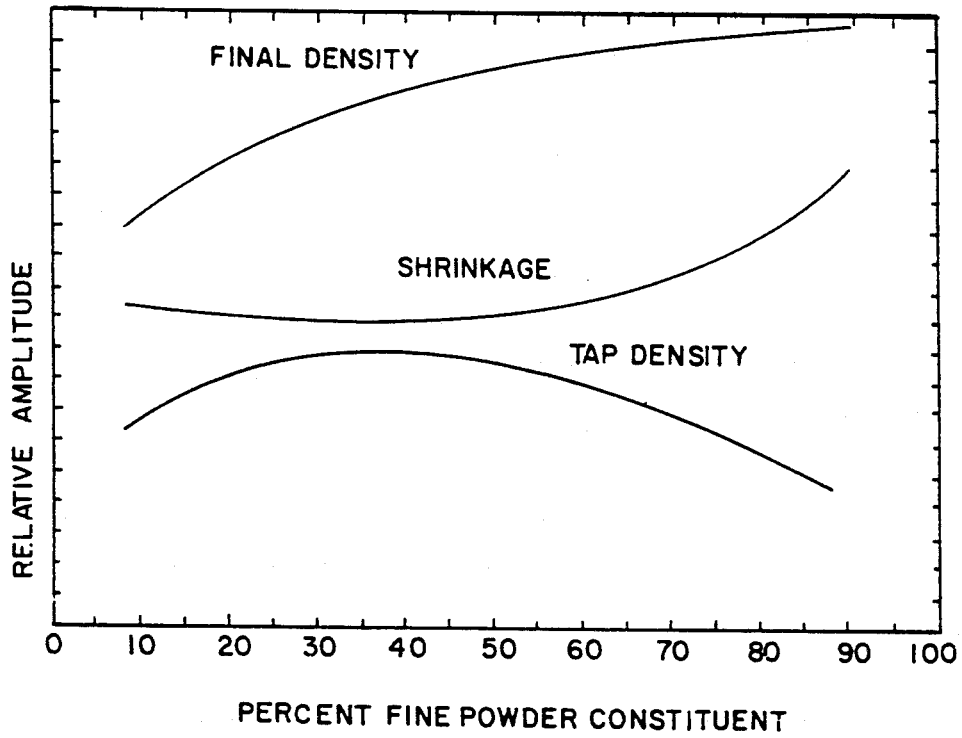

In general, the method of the present invention comprises blending powders having the desired final chemistry of a part to be producing and possessing a certain pore size and certain pore volume. Pore volume is indicated by the density of a packed homogeneous mixture of the dry powders, and is hereafter referred to as tap density. It is desirable to use a single powder possessing the correct chemistry; however, a blend of at least two powders having different particle diameters decreases the amount of binder required to achieve the same rheology. Also, debinding time is decreased due to an increase in pore size. In addition, carbon pick-up from the binder may be desirable, for chemistry, or to produce liquid phase sintering conditions. Carbon pick-up should therefore be taken into account with the powder chemistry.

Blended powders are mixed with a liquid thermosetting binder having a viscosity less than 1,000 cps, in an amount to at least fill the pore volume of the powder. (This amount is calculated from the tap density). The binder may also contain modifiers such as acids, glycerin, or alcohols; this being done to improve mix rheology. Prior to adding the binder, the powder or binder may be mixed with a surface modifying agent that will disperse the powder in the binder. In addition, catalysts may be added that lower the curing temperature and/or speed curing time.

If no processing is to be done to the parts between the molding and sintering steps, the mix should include sufficient amounts of an oxidizing agent, such as a metal oxide or other chemical, that will produce an oxidizing vapor upon its decomposition. This oxidizing vapor promotes the burning out of the cured resin within the pores of the part as it is heated.

The liquid mixture, which has a viscosity less than 150,000 cps, is vacuum degassed to remove entrapped air bubbles, and then formed into the shape of the final part, shrinkage being taken into account in proportion to the volume percentage of the powder in the mix and the final density which can be achieved. Parts can be made by a variety of processes wherein the mix is poured, injected, syringed, or otherwise worked into a desired shape and then heated to set the shape when the binder cures. These processes include, but are not limited to, injection molding and a variety of well-known, low cost methods using elastomeric tooling.

After forming the oversized shape of the part, the parts are debinderized and sintered in a single operation in a vacuum sintering furnace. This is accomplished because the film forming property of the cured resin leaves the body of the part open, the oxidizing conditions which exist within the pores of the part assist in burning the binder out, and low pressures insure the diffusion and removal of evolving vapors through the part's pores. These oxidizing conditions usually come from the addition of oxidizing agents; but when using metal powders, the condition can also result from or be assisted by oxidizing ("rusting") of the parts, either in a separate oven prior to sintering, or by introducing an oxidizing atmosphere at low temperature prior to raising the temperature to the sintering temperature. In contrast to other processes, this interim step does not result in appreciable binder loss, and is not necessary when a compound of sufficient oxidizing potential has been added in a sufficient amount.

Debinding the part is a diffusion controlled phenomenon and is insured by debinding in a vacuum of less than 100 mT. Debinding at atmospheric pressure causes the part to "explode" due to rapid evolution of binder, or causes the debinding time to be so long as to negate the advantage of this method.

Since debinding is a diffusion phenomenon, the amount of binder removed, and therefore the final carbon content of the part, is a function of pore size, pressure and the rate of heating to the sintering temperature. With more binder and a smaller pore size, as would be the case with a low tap density powder mixture, a longer time is required for binder removal.

In accordance with the method of the present invention, it is desirable to select a mix of powders combined to have a desired chemistry, yet having average particle sizes varying by a factor of six to ten, so as to reduce material costs, debinding time, and shrinkage, and also improve dimensional accuracy. FIG. 1 graphically illustrates the relationship between tap density, resin demand (the amount of resin needed for proper rheology), debinding time, percent of shrinkage and final density, as a finer powder constituent is added to a coarser powder.

As shown, for nearly all powder systems, a peak in tap density occurs at around 40% of the finer constituent. At this peak, the amount of resin needed for rheology, the debinding time, and the percent of shrinkage involved are all at a minimum. The final density achieved, although not a maximum, may or may not be desirable at this maximum tap density. What is done therefore (once these relationships are established for the powder involved), is to choose the nominal final density desired, then determine the percentage of weight of the two powder sizes to use. This, in turn, determines the amount of binder to add.

An oxidizing agent is also added to the mix to provide localized oxidizing conditions within pores during heating to the sintering temperature under a vacuum. Generally, it is preferred to use an oxide compatible with the powder being used. The size and amount of oxidizing agent added is important in determining the debinding potential of the mixture. Smaller sizes yield more surface area and a better distribution of the oxidizing vapors, thus enhancing debinding for a given weight addition Preferably, oxidizing compound is ground to the average size of the smallest powder constituent, and added in an amount equivalent to 20% of the resin weight used.

The "furan" family of thermosetting resins are preferred. The family is based on furfural, furfuryl alcohol, or furan as the primary constituent. These resins all have viscosities of less than 200 cps, are film formers when cured, and produce water as a byproduct of the condensation reaction. Each may be mixed with resins that form co-polymers such as urea-, melamine-, or phenol formaldehyde to improve the strength of the part. Recent improvements in the technology of these resins incorporates a "latent catalyst" that is activated at temperatures slightly above room temperature, which substantially lowers the curing temperature of the resin. Generally, these low curing temperature resins are preferred if a reduction in the working life of the mix can be tolerated.

Surface active agents, also referred to as surfactants, surfiers, or coupling agents, are incorporated into the mix to improve both suspension of the powder and mix rheology. Surfactants are available in powder or liquid form and are added to the powder or resin depending upon the chemistry of the surfactant. The action of these agents is well known in the art. This action removes adsorbed water from powder surfaces, reduces the surface free energy, reduces inter-particle attractive forces, and provides chemical and physical interaction with binder molecules. This results in dispersion, suspension, and a reduction in volume of liquid ingredients necessary to achieve a certain viscosity.

When using a binder system that does not rely upon a latent catalyst, a large number of surfactants are effective, due to the polar nature and low molecular weight of the resins. For example, organofunctional silanes and titanates, normally prescribed for use with thermoset urethanes in conventional injection molding, can be utilized; as well as vinyl stabilizers and quaternary ammonium salts common to the cosmetics industry. Some benefit is also observed with organic block copolymers having an HLB value greater than 11.

The latent catalyzed resin system, however, relies upon Lewis acid reactions that are buffered or accelerated; or have the Lewis acid species ionized out of solution with these ionic surfactants. Therefore, with this system, non-ionic surfactants can be utilized; but, only by selecting a suitable molecular weight that provides a high degree of dispersion effect with minimum buffering effect. For example, low molecular weight (approx. 9,000) of polyvinyl pyrrolidone produce excellent dispersions, but inhibit curing of the resin. Higher molecular weights (greater than 40,000) on the other hand, do not affect the reaction as much, but produce poorer dispersions.

A modifier is usually added for two reasons. First, it improves rheology, i.e. decreases thixotropy and helps keep the powder from settling in the thin resin. Requirements for the modifier are therefore a higher viscosity than the resin, a boiling point above the curing temperature of the resin, and miscibility with the resin. Second, not all of the resin which must be added to fill the pore volume of the powder is needed to produce a rigid part when the resin cures. The excess amount above that required for strength can be replaced by an easily evolved modifier, further decreasing debinding time. The amount of modifier to add is determined empirically, since it has a negative effect on curing time and strength of the cured part. The amount of modifier added is usually 20%–35% of the resin weight.

The sum of liquid constituents-resins, catalysts, modifiers, and surfactants make up the total amount of binder to add to the powder. It is this amount that needs to fill the pore space of the powder for proper rheology.

The dry ingredients are then weighed out into a suitable solids blender, and blended for a period of time sufficient to insure their uniformity. The liquid and solid ingredients are then combined into a mixer, for example, a bread dough mixer, and mixed until the mix attains a uniform consistency and color. The mixing operation generally takes about two minutes with a stop after one minute to wipe down the sides of the mixing bowl with a rubber spatula.

To achieve consistent density parts, it is essential for any air introduced into the mix by the mixing operations to be removed as completely as possible. This is readily accomplished by placing the mix in a bell jar, evacuating the bell jar to a vacuum of at least 27 inches of mercury and holding for approximately 30 minutes.

The mix can now be used in a variety of molding processes. The cure time and temperature are dependent not only on each other, but also upon the amount and type of resin, amount and type of catalyst being used, and part section thickness. Generally, a furfuryl alcohol/urea formaldehyde based binder catalyzed with 5%–20% benzene sulfonic acid will cure in 15–30 seconds at 400° F. (204° C.). A furfuryl alcohol based binder latently catalyzed will cure in 30–45 seconds at 250° F. (121° C.). This mixture can also cure at room temperature and pressure, in 3–24 hours, depending on the amount of catalyst and type of surfactant being used.

Figure 3:
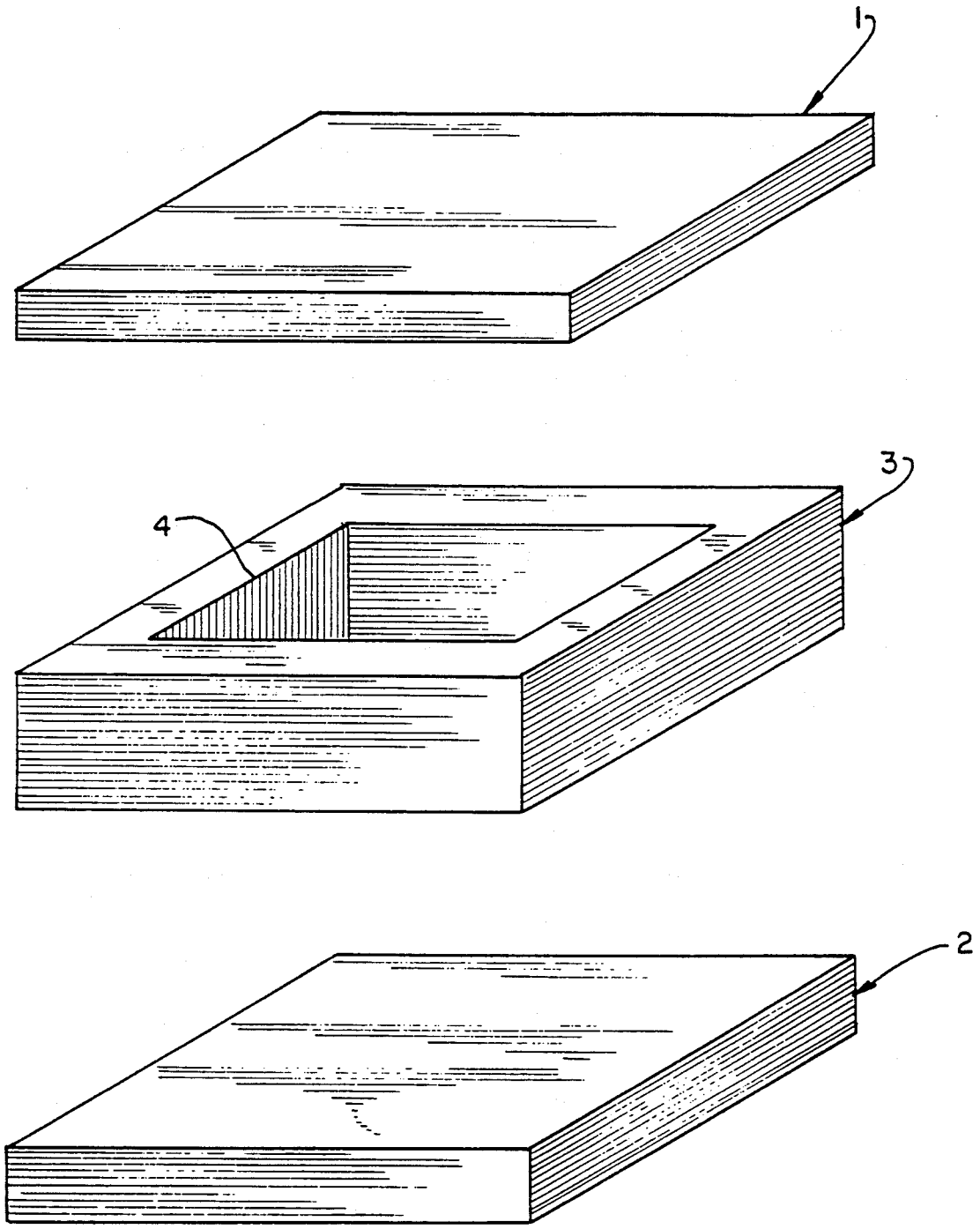
FIG. 3 is a perspective view of plates used in molding a mixture.

Injection molding is easily accomplished using equipment designed for thermoset encapsulation or the injection molding of liquid silicone rubber. Rubber molds may also be used since the mix can be syringed, poured, spooned, or spread into the mold and subsequently heated to form a rigid shape. Molds made of several plates (see FIG. 3) may be used. The plates are assembled and the mix poured into the cavity formed by the plates. The assembly is then placed in a laminating press and heated to cure the resin. The assembly is then removed from the press, cooled, disassembled and the rigid part removed. This provides a simple way of producing test samples for new mixes, or monolithic preforms that may be machined for prototyping purposes.

Debinding time is determined from data that accounts for pore size, amount of binder used, section thickness, and final carbon content. The debinding time is the time the sintering furnace should take to heat from 400° F. (204° C.) to the sintering temperature to remove the binder. The sintering temperature, in turn, is a function of the powders being used.

It will be understood that although the examples of the preferred embodiments of the invention now discussed are with respect to steel powders, the invention also applies to other metals, alloys, ceramics, and mixtures of metals and ceramics.

EXAMPLE I

Three rectangular steel samples containing less than 0.5 % carbon were made by weighing out the following compositions of powder:

58 g. Water Atomized Iron Powder, avg. size sixty micro-m 42 g. Unreduced Carbonyl Iron Powder, avg. size five micro-m 0 5 g. $Fe_3O_4$, avg. size five micro-m The powders were hand blended until a consistent color was reached. The blending time was approximately one minute. To this the following liquid ingredients were added:

3.0 g. Delta Resin's Airkure 6-24 (a furfuryl alcohol-/urea formaldehyde resin)

1.0 g. Glycerin

This mixture was then hand mixed to paste consistency. The mixing time was about one minute. Finally, to improve rheology, 0.3g. of Delta Resin's 17-120A Catalyst (Benzene Sulfonic Acid) was added. The mix was then stirred until the slight exothermic reaction produced subsided. This stirring time was approximately two minutes. The mix then had a smooth, creamy, consistency.

This mix was spooned into a mold consisting of three plates (see FIG. 3): two flat top and bottom plates (plates 1 and 2 in FIG. 3), and a middle plate 3 containing a rectangular cut-out 4. The cut-out was filled with mix. Then, top plate 1 was fastened to the other two plates. The entire plate assembly was placed between the 450° F. (232° C.) platens of a laminating press and the press was closed. After five minutes, the plates were heated to 450° (232° C.) and held for a sufficient period of time to harden the part. The press was then opened, the plates removed and disassembled, and a sample was pushed out from the middle plate. This process was repeated for two other samples.

Each part was then placed in a vacuum furnace, without any other treatments or processing, and heated at 10° F./min to 2300° F. (1260° C.). The part was held at this temperature for three hours and then cooled to room temperature. The average carbon content of the three samples was determined to be 0.42%.

EXAMPLE II

A mixture of the following recipe was made:

57.4% Water Atomized, Iron Powder, Avg. size 60 micro-m 41.6% Unreduced five micro-m Carbonyl iron powder 1.0% $Fe_3O_4$, five micro-m avg. size 5.8% Ashland 65-016 resin, based on the sum of powder constituents 2.0% Glycerin, based on the powder constituents 20% Ashland 65-058 catalyst, based on the amount of resin The dry powders were first blended in a one quart, V-shell solids blender. Liquids comprised by the Ashland Resin and catalyst were mixed together separately and the resultant mixture added to the solids. This was done in a 4½ quart kitchen mixer. The entire mixture was then mixed for two minutes, stopping periodically to wipe down the sides of the bowl with a spatula. The mixture was then held under a vacuum of more than 27 inches of mercury for 30 minutes to remove entrapped air. Finally, the mixture was poured into the feeding system of a pneumatic press configured for the injection molding of silicone, and equipped with a die capable of producing tensile test specimens.

A tensile test specimen was produced by injecting at 250° F. (121° C.) and holding for one minute under a pressure of less than 2500 psi before ejecting the specimen. The specimen was sufficiently oversized to produce a sintered gage length of 1"(2.54 cm) and a gage diameter of approximately 0.25"(0.63 cm).

The tensile test specimen was placed in a low temperature oven and held at 375° F. in stagnant air for 24 hours. The specimen was then heated under a vacuum of less than 80mT at 10° F./min to 2300° F.(1260° C.), held at that temperature for four hours, and then slowly cooled to room temperature. The final density of the specimen was calculated from the green density and radial shrinkage to be 6.72 g/cc, the ultimate tensile strength was 19,000 psi, and the carbon content was 0.032%.

EXAMPLE III (Demonstration of dispersion with polyvinyl pyrrolidone.)

50.0 g samples of unreduced 5 micro-m avg. size carbonyl iron powder were weighed into identical 100ml beakers. Into one of the samples, 1 750 g. of polyvinyl pyrrolidone powder having a molecular weight of 9,000 (BASF's Luviskol K-17) was mixed in by hand stirring. No surfactants were added to the other sample. In a separate beaker, 10.0 g. of Ashland 65-016 resin and 2.0 g. of Ashland 65-058 catalyst were mixed together. 5.50 g. of this resin/catalyst mixture were weighed into each of the samples. The sample containing the polyvinyl pyrrolidone was mixed up, by hand, to a cake-frosting consistency. The sample containing no polyvinyl pyrrolidone could not be mixed to obtain any fluid characteristics; it being comprised of loose powder and several clumps of agglomerated powder.

EXAMPLE IV

A mixture for injection molding was made using the following recipe:

69.3% Unreduced carbonyl iron powder, avg size 5 micro-m 29.7% Water atomized steel powder, avg. size 60 micro-m 1.0% $Fe_3O_4$.

3.5% Polyvinyl pyrrolidone powder, BASF Luviskol K-17, based on weight of iron and steel powder 6.7% Ashland 65-016 Resin, based on weight of iron and steel powder 20.0% Ashland 65-058 catalyst, based on weight of resin All powder constituents were weighed out and mixed in a V-shell solids blender for two minutes. The solids were then transferred to a kitchen blender and the liquid resin and catalyst, which had been previously combined, were added. The entire mixture was then blended to an even consistency and vacuum degassed under a vacuum of greater than 27 inches Hg for 30 minutes.

The same press and tooling used for Example III were used for this example, except the cycle time was appropriately lengthened to account for a buffering effect caused by the molecular weight of polyvinyl pyrrolidone. A tensile specimen was produced by injecting at 210° F. (99° C.) and holding for 150 seconds at a pressure of 1950 psi.

The specimen was then placed into a vacuum furnace, without any other processing, and heated at 15° F./min to 700° F.(371° C.), 6° F./min to 2100° F. (1150° C.), and 28° F./min to 2300° F. (1260° C.). The sample was held at 2300° F.(1260° C.) for 180 minutes and cooled slowly to room temperature.

The specimen was found to have an ultimate tensile strength of 49,000 psi, a density (determined by oil impregnation, microstructural evaluation, and shrinkage calculation) of 7.7 g/cc, and a carbon content of 1.4%. Microstructural evaluation of the specimen revealed a supersolidus liquid phase had formed on the grain boundaries.

EXAMPLE V

A semi-permanent mold was made using a steel part for a machine tool as a master. The flat portion of the part was glued to the bottom of a shallow box, and the box filled with silicone rubber molding compound, for example, General Electric's RTV-700. After the rubber had cured, it was stripped from the box, leaving the shape of the steel master in the rubber.

The mix of example II was then poured into the rubber mold to fill it. The mold was placed in a muffle furnace at 200° F. (93° C.) for eight hours, curing the powder mixture, and enabling it to be stripped from the elastomer mold. Three similar parts were made using the same mold.

Each part was placed into a vacuum furnace and heated at 10° F./min to 2300° F. (1260° C.), under 60mT vacuum, held at that temperature for four hours, and nitrogen ($N_2$) gas quenched. The part's density averaged 7.2 g/cc, as measured by an oil impregnation technique, and had an average carbon content of 0.22%. Two 0.002 inch (0.005 cm) high by 0.010 inch (0.025 cm) wide ridges, extending the 1.75 inch (4.45 cm) length of one side of the part were faithfully reproduced.

In view of the above, it will be seen that the various objects and features of this invention are achieved and other advantageous results obtained.

As various changes could be made in the above methods without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A method for producing a part from a powder having desired chemical properties comprising:
   - mixing the powder with a binder having as its primary constitutent a thermosetting condensation resin, the binder being mixed with the powder in an amount sufficient to fill the void volume of the powder;
   - mixing one of the powder or the binder, or both, with a substance which releases oxidizing vapors through a chemical reaction;
   - forming the resultant mixture into an appropriate part shape;
   - curing the part for the resin to form a film which leaves pores in the part open; and,
   - heating the part in a vacuum to the appropriate sintering temperature to cause a localized oxidation within the pores from the oxidizing vapors released by the substance to burn-out the film.

2. The method of claim 1 wherein the resin has a viscosity of less than 1,000 cps.

3. The method of claim 1 further including oxidizing the powder prior to heating the part to facilitate interpore oxidation, and wherein heating the part in a vacuum to the appropriate sintering temperature includes heating to an appropriate temperature to cause decomposition of the powder's oxides to oxidizing gases which burn-out the film.

4. The method of claim 1 further including oxidizing the powder contemporaneously with heating the part to facilitate interpore oxidation.

5. The method of claim 1 wherein the thermosetting resin is furfuryl alcohol.

6. The method of claim 1 wherein the thermosetting resin is furfural.

7. The method of claim 1 wherein the thermosetting resin is a mixture selected from the group consisting of furfuryl alcohol and urea formaldehyde; furfuryl alcohol and phenol formaldehyde; and, furfuryl alcohol and melamine formaldehyde.

8. The method of claim 7 wherein the mixture is produced by combining one or more of the stated constituents.

9. The method of claim 1 further including incorporating a catalyst into the resin to modify the resin so it cures at a temperature less than 450° F. (232° C.).

10. The method of claim 8 wherein the catalyst incorporated is in the range of 5%–50% of the resin weight.

11. The method of claim 1 further including adding an acid to the mixture to partially react the resin and improve flow characteristics of the mixture, cure hardness, and processing time.

12. The method of claim 1 further including adding a modifier to the mixture in such amount that the binder and modifier at least equal the pore volume of the powder.

13. The method of claim 12 wherein the amount of modifier added is in the range of 1–50% of the resin weight.

14. The method of claim 12 wherein the modifier is glycerin.

15. The method of claim 12 wherein the modifier is an alcohol possessing eight or more carbon atoms per molecule.

16. The method of claim 1 wherein the powder is a reduced carbonyl iron powder having an average particle size of approximately five micro-m.

17. The method of claim 1 wherein the powder is a non-reduced carbonyl iron powder having an average particle size of approximately five micro-m.

18. The method of claim 1 wherein the powder comprises a mixture of water atomized steel powder having an average particle size of approximately sixty micro-m, and carbonyl iron powder having an average size of approximately five micro-m.

19. The method of claim 1 wherein the part is formed by injection molding.

20. The method of claim 1 wherein the part is formed using semi-permanent tooling such as silicone rubber tooling.

21. The method of claim 1 wherein the part is formed using a plurality of plates at least one of which includes a cut-out defining the shape of the part, said cut-out being oversized for the part.

22. A method of removing a binder from a mixture of a powder and the binder wherein an additive is incorporated in the mixture, the additive producing an oxidizing vapor when it thermally decomposes with the oxidizing vapor assisting in burning-out the binder.

23. The method of claim 22 wherein the additive is an oxidizing agent comprising an oxide compatible with the powder.

24. The method of claim 23 wherein the powder is an iron powder and the additive is selected form among $FeO$, $Fe_2O_3$, and $Fe_3O_4$.

25. The method of claim 22 wherein the additive is either ammonium nitrate, or ferric nitrate.

26. The method of claim 1 further including adding a surface active agent to the solid or liquid ingredients.

27. The method of claim 26 wherein the surface active agent is polyvinyl pyrrolidone.

28. The method of claim 26 wherein the surface active agent is a polyquaternary ammonium salt.

29. The method of claim 26 wherein the surface active agent is a neoalkoxy titanate compound.

30. A method of sintering powders to near zero porosity through formation of a liquid phase between powder particles comprising:
   - adding to the powder, organic compounds producing a film coating on the powder particles; and
   - heating the resultant mixture in such a manner that the coating remains on the particles at a temperature sufficient to chemically react the coating and the powder and form the liquid phase.

31. The method of claim 30 wherein the resin film is produced by:
   - mixing the powder with a binder having as its primary constituent a thermosetting condensation resin, the binder being mixed with the powder in an amount sufficient to fill the void volume of the powder;
   - mixing one of the powder or the binder, or both, with a substance which release oxidizing vapors through a chemical reaction;

forming the resultant mixture into an appropriate part shape;

curing the part for the resin to form a film which leaves pores in the part open; and, heating the part in a vacuum to the appropriate sintering temperature to cause a localized oxidation within the pores from the oxidizing vapors released by the substance to burn-out the film.

32. A method for producing a part from a powder having desired chemical properties comprising:

mixing the powder with a binder having as its primary constituent a thermosetting condensation resin, the binder being mixed with the powder in an amount sufficient to fill the void volume of the powder and the mixing of the powder and binder including addition of a chemical which evolves an oxidizing vapor upon decomposition;

forming the resultant mixture into an appropriate part shape;

curing the part for the resin to form a film which leaves pores in the part open; and, heating the part in a vacuum to the appropriate sintering temperature to cause the decomposition, with the resultant oxidizing vapor producing an interpore oxidizing condition during heating of the part.

33. A method for producing a part from a powder having desired chemical properties comprising:

mixing the powder with a binder having as its primary constituent a thermosetting condensation resin, the binder being mixed with powder in an amount sufficient to fill the void volume of the powder;

forming the resultant mixture into an appropriate part shape;

curing the part for the resin to form a film which leaves pores in the part open;

oxidizing the powder particles prior to heating the part of facilitate interpore oxidation; and, heating the part in a vacuum to the appropriate sintering temperature thereby causing decomposition of the powder's oxides to oxidizing gases which burn-out the film.

* * * * *